US006388218B1

(12) United States Patent
Ando et al.

(10) Patent No.: US 6,388,218 B1
(45) Date of Patent: May 14, 2002

(54) PUSH BUTTON SWITCH COVER AND METHOD FOR MANUFACTURING SAME

(75) Inventors: Hitoshi Ando, Saitama; Takeo Shirasawa, Nagano; Fumio Ohshima, Nagano; Noriyoshi Kiyosawa, Nagano; Hirohide Sato, Nagano, all of (JP)

(73) Assignee: Shin-Etsu Polymer Co. Ltd. (JP)

( * ) Notice: Subject to any disclaimer, the term of this patent is extended or adjusted under 35 U.S.C. 154(b) by 0 days.

(21) Appl. No.: 09/436,412

(22) Filed: Nov. 9, 1999

(30) Foreign Application Priority Data

Dec. 22, 1998 (JP) ..... 10-364919
Mar. 26, 1999 (JP) ..... 11-084941

(51) Int. Cl.[7] ..... H01H 1/10
(52) U.S. Cl. ..... 200/512; 200/517
(58) Field of Search ..... 200/5 A, 341–345, 200/512–517

(56) References Cited

U.S. PATENT DOCUMENTS 4,775,574 A * 10/1988 Fukushima et al. ..... 428/209
4,948,927 A * 8/1990 Pajak ..... 200/33 R
4,958,148 A * 9/1990 Olson ..... 340/712
5,130,176 A * 7/1992 Baerveldt ..... 428/192
5,911,317 A * 6/1999 Tsai ..... 200/514
5,986,228 A * 11/1999 Okamoto et al. ..... 200/516

FOREIGN PATENT DOCUMENTS

| | | |
|---|---|---|
| JP | 03 246835 | 11/1992 |
| JP | 07 021875 | 1/1995 |
| JP | 10 255592 | 9/1998 |

* cited by examiner

*Primary Examiner*—Michael L. Gellner
*Assistant Examiner*—Nhung Nguyen
(74) *Attorney, Agent, or Firm*—Lerner, David Littenberg, Krumholz & Mentlik, LLP

(57) ABSTRACT

A push button switch cover capable of enhancing positional accuracy between a cover sheet and dish-shaped metal springs, thereby highly improving keying characteristics and reducing manufacturing cost. The cover sheet is provided on a front surface thereof with key tops and on a rear surface thereof with pressing projections in correspondence to the key tops. The dish-shaped metal springs are each bonded to a respective one of the pressing projections by an elastic adhesive section while keeping an apex of the dish-shaped metal spring abutted against a central portion of the pressing projection.

18 Claims, 7 Drawing Sheets

PUSH BUTTON SWITCH COVER AND METHOD FOR MANUFACTURING SAME

BACKGROUND OF THE INVENTION

This invention relates to a cover for a push button switch used as a data input unit or a switch unit for a mobile communication equipment such as a mobile phone, a vehicle-mounted telephone or the like, a measuring instrument, a remote controller, a handy terminal or the like, an input unit in the field of a domestic electric appliance, an electronic equipment, a communication equipment, or the like. More particularly, the present invention relates to a push button switch cover which permits the push button switch to exhibit improved keying characteristics such as reduced stroke characteristics, increased click characteristics and the like.

Now, a conventional push button switch which is used for an input unit for a mobile phone or the like will be described with reference to FIG. 14. The push button switch includes a cover 100, which is received in a casing of the equipment or phone while being mounted on a circuit board 102 through dish-shaped springs 104 made of metal such as phosphor bronze, SUS stainless steel or the like, resulting in the push button switch being constituted. The circuit board 102 is provided thereon with contacts 106. In the push button switch thus constructed, displacement of each of key buttons 108 toward the circuit board 102 permits a corresponding one of pressing projections 110 to displace the dish-shaped metal spring 104.

Several or tens of such dish-shaped metal springs 104 are arranged in perforated portions of a perforated PET sheet 112 having a pressure-sensitive adhesive or an adhesive coated thereon by means of an aligning unit such as a parts feeder or a robot, a jig, or the like while being kept projected. Then, a pressure-sensitive adhesive sheet 114 is positioned over the dish-shaped metal springs 104 to fix the dish-shaped metal springs 104 between the perforated PET sheet 112 and the pressure-sensitive adhesive sheet 114, resulting in a dish-shaped metal spring sheet being provided, which is then superposed on the push button switch cover 100.

However, the conventional push button switch cover 100 thus constructed is provided separately from the dish-shaped metal springs 104. This causes alignment between each of the pressing projections 110 of the cover 100 and an apex of a corresponding one of the dish-shaped metal springs 104 during superposition of the dish-shaped metal spring sheet on the cover 100 to be highly difficult or troublesome. Also, a procedure for inspecting such alignment has not been established in the art. Thus, the conventional push button switch cover fails to provide the push button switch with satisfactory keying characteristics.

In particular, positioning of the perforated PET sheet 112 mounted thereon with the dish-shaped metal springs 104 with respect to the push button switch cover 100 for superposition of the former on the latter is carried out by inserting positioning pins of an aligning jig through reference holes of the perforated PET sheet 112 and cover 100. Unfortunately, this causes positional deviation, at the most, between 0.2 mm and 0.5 mm to occur between the PET sheet 112 and the cover 100 due to misregistration between the reference holes and gaps between the reference holes and the positioning pins. Also, the prior art fails to permit accuracy of positioning between the apex of each of the dish-shaped metal springs 104 and each of the projections 110 of the push button switch cover 100 to be confirmed. Thus, the push button switch cover is assembled while keeping positional accuracy between the apex of the dish-shaped metal spring 104 and the projection 110 of the cover 100 from being increased, resulting in the push button switch cover being deteriorated in keying characteristics such as keying load, pressing feeling and the like.

In addition, the prior art requires the PET sheet 112 for holding the dish-shaped metal springs 104 and the pressure-sensitive adhesive sheet 114 fixed on the circuit board 102 are also required, leading to an increase in manufacturing cost.

Moreover, in the conventional push button switch cover, the pressing projections 110 are each compressedly deformed by impact resilience of the dish-shaped metal spring 104, to thereby cause a stroke generating peak load f1 (peak stroke s1) and a make stroke s2 generating make load f2 to be increased as indicated at a thin solid line B in FIG. 8, resulting in operation feeling being excessively soft and lacking clearness or distinctness. The ratio of differential load between peak load and make load to peak load will be referred to as "click ratio" hereinafter.

In order to provide operation feeling with increased clearness, it is desired to eliminate compressive deformation of the pressing projections 110 to coincide press load (gf)-stroke (mm) characteristics of the whole cover with ideal characteristics of the dish-shaped metal spring per se as indicated at a broken line C in FIG. 8. It would be considered that the cover is increased in hardness for elimination of compressive deformation of the pressing projections. However, when the dish-shaped metal spring 104 is deformed through a thin wall portion of the cover 100 of, for example, 0.1 to 0.3 mm in thickness to generate click feeling in the cover shown in FIG. 1, an increase in hardness of the cover 100 tends to cause the cover to be broken due to repeated displacement, leading to a deterioration in keying durability of the cover 100.

In addition, the inventors found that, when the dish-shaped metal springs are bonded to the pressing projections by an elastic adhesive, the push button switch cover causes a stroke with respect to load during keying operation to be increased if the amount of the elastic adhesive is insufficient and causes the stroke to be reduced if the amount is excessive, to thereby reduce a click ratio, leading to a deterioration in bonding durability and functional durability. Also, inclination of the dish-shaped metal spring arranged by means of the adhesive is caused to lead to positional deviation of the dish-shaped metal spring in X-Y directions. For example, peak load is increased above positional deviation of 0.1 mm, resulting in the bonding durability being substantially reduced in association with a reduction in click ratio. A minimum value of inclination of the dish-shaped metal spring which can be visually confirmed is 2.5 degrees.

SUMMARY OF THE INVENTION

The present invention has been made in view of the foregoing disadvantages of the prior art.

Accordingly, it is an object of the present invention to provide a push button switch cover which is capable of increasing positioning accuracy with which a cover substrate and a dish-shaped metal spring are positioned with respect to each other.

It is another object of the present invention to provide a push button switch cover which is capable of exhibiting satisfactory keying load characteristics, to thereby exhibit increased pressing feeling over a long period of time.

It is a further object of the present invention to provide a push button switch cover which is capable of eliminating arrangement of members such as a pressure-sensitive adhesive sheet for fixing dish-shaped metal springs, a perforated PET sheet and the like, to thereby significantly reduce a manufacturing cost.

It is still another object of the present invention to provide a push button switch cover which is capable of minimizing affection of compressive deformation of pressing projections, to thereby provide satisfactory click feeling and clear or distinct keying feeling.

It is yet another object of the present invention to provide a method for manufacturing a push button switch cover which is capable of facilitating inspection of positional accuracy between pressing projections and dish-shaped metal springs.

In accordance with one aspect of the present invention to provide a push button switch cover is provided. The push button switch cover includes a cover substrate, which is provided on a front surface thereof with at least one key top and on a rear surface thereof with at least one pressing projection in a manner to correspond to the key top. The push button switch cover also includes at least one dish-shaped metal spring arranged on the pressing projection corresponding thereto. The dish-shaped metal spring is fixed on the pressing projection corresponding thereto through an adhesive section in a manner to be abutted at an apex thereof against a central portion of the pressing projection.

Also, in accordance with this aspect of the present invention, a push button switch cover is provided. The push button switch cover includes at least one key top, at least one pressing projection arranged on a rear side of the key top, and at least one dish-shaped metal spring having a dome-shaped top and arranged on the pressing projection corresponding thereto. The dish-shaped metal spring is bonded at the dome-shaped top thereof to a central portion of the pressing projection by means of an elastic adhesive section.

In a preferred embodiment of the present invention, the adhesive section comprises an elastic adhesive having an elongation of 75 to 700% and preferably 75 to 250% in an amount of 2 to 7 mg.

In a preferred embodiment of the present invention, the elastic adhesive has an initial viscosity of 20 to 150 Pa·s and preferably 30 to 100 Pa·s.

In a preferred embodiment of the present invention, the elastic adhesive is constituted of 100 parts by weight of a main adhesive ingredient and 5 to 50 parts by weight of a silicone adhesive ingredient.

In a preferred embodiment of the present invention, the cover substrate is made of silicone rubber having a Shore A hardness of 40 to 70 and the pressing projection is integrally formed on the cover substrate. The elastic adhesive section has a Shore A hardness of 20 to 90.

In a preferred embodiment of the present invention, the pressing projection is integrally formed on the rear surface of the cover substrate. The key top is formed on the front surface of the cover substrate.

In a preferred embodiment of the present invention, the pressing projection is integrally formed on the rear surface of the cover substrate. The key top is made of a resin material and bonded to the front surface of the cover substrate.

In accordance with another aspect of the present invention, a method for manufacturing a push button switch cover is provided. The method includes the steps of: providing a cover substrate which is formed on a front surface thereof with at least one key top and on a rear surface thereof with at least one pressing projection in a manner to correspond to the key top; applying an adhesive to the pressing projection to form an adhesive section on the pressing projection; carrying the cover substrate to a dish-shaped metal spring feed position while keeping the pressing projection facing up; and pressing a dish-shaped metal spring onto the pressing projection corresponding thereto while aligning a central portion of the pressing projection with an apex of the dish-shaped metal, whereby the dish-shaped metal spring is bonded to the pressing projection through the adhesive section.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1A:
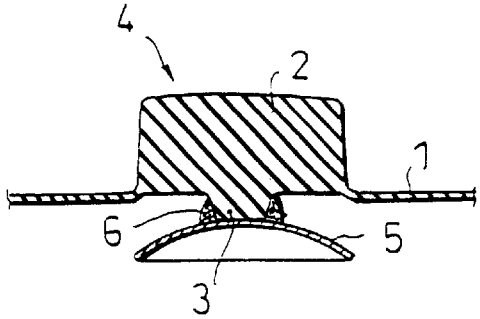
FIG. 1A is a fragmentary vertical sectional view showing a first embodiment of a push button switch cover according to the present invention.

Now, the present invention will be described hereinafter with reference to FIGS. 1A to 13C, wherein like reference numerals designate like or corresponding parts throughout.

Figure 1B:
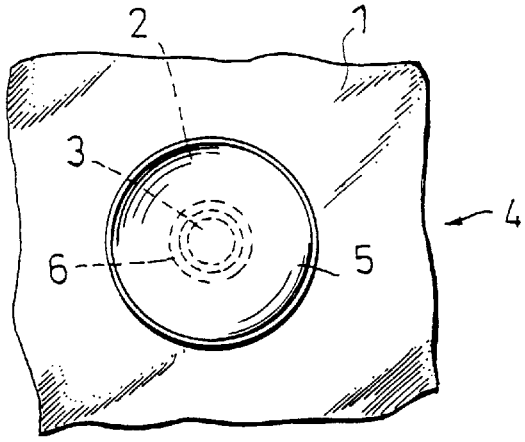
FIG. 1B is a bottom view of the push button switch cover shown in FIG. 1A.
Figure 1C:
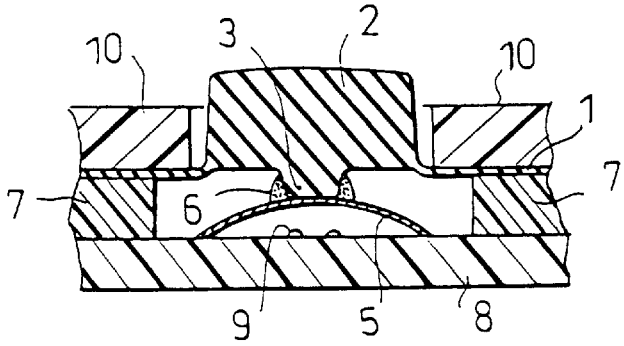
FIG. 1C is a fragmentary vertical sectional view showing the push button switch cover of FIG. 1A incorporated in a push button switch.

Referring first to FIGS. 1A to 1C, an embodiment of a push button switch cover according to the present invention is illustrated. A push button switch cover of the illustrated embodiment which is generally designated at reference numeral 4 includes a cover sheet or substrate 1, which is formed on a front surface thereof with key tops 2. The key tops 2 each include a display section (not shown) such as a character, a symbol or the like. The cover sheet 1 is formed on a rear surface thereof with pressing projections 3 in a manner to positionally correspond to the key tops 2. The push button switch cover 4 also includes dish-shaped metal springs 5 arranged so as to correspond to the pressing projections 3, respectively. Each of the dish-shaped metal springs 5 is arranged in a manner to be abutted at an apex thereof against a central portion of the pressing projection 3 corresponding thereto and is fixed on the pressing projection 3 through an adhesive section 6.

In the illustrated embodiment, the push button switch cover 4 having the dish-shaped metal springs 5 fixed thereon, as shown in FIG. 1C, is mounted through a spacer 7 on a circuit board 8 so as to be positioned above fixed contacts 9 and then received in a casing 10 of equipment such as a mobile phone, resulting in functioning as a push button switch unit.

The spacer 7 may be formed integrally with the cover sheet 1. Alternatively, it may be formed separately from the cover sheet 1. For example, it may be made of a film of an insulating resin material such as polyethylene telephthalate (PET), polyethylene naphthalate (PEN) or the like and formed to have a predetermined thickness.

The spacer 7 may be formed to have a thickness sufficient to permit click feeling to be adjusted as desired. Also, arrangement of the spacer 7 is not necessarily required so long as a base section of the cover sheet 1 is formed to have a thickness sufficient to ensure a satisfactory pressing operation.

The cover sheet 1 may be made of a synthetic rubber material such as silicone rubber, EPDM or the like, a thermoplastic elastomer such as polyester, polyurethane, polyolefin or polystyrene, or the like by injection molding, compression molding or the like.

The key tops 2 of the cover sheet 1 are arranged so as to be outwardly projected from the casing 10, resulting in the key tops functioning as a press operation section by an operator.

Now, manufacturing of the push button switch cover of the illustrated embodiment thus constructed will be described hereinafter with reference to FIGS. 2 to 4.

An adhesive applying section 11 is provided for forming adhesive sections 6 on the pressing projections 3 of the cover sheet 1. Also, an image processing section 12 including a CCD camera is provided. The adhesive applying section 11 and image processing section 12 are used for applying an adhesive to the pressing projections 3 of the cover sheet 1 to form the adhesive sections 6. Then, the cover sheet 1 is carried to a dish-shaped metal spring feed position while keeping the pressing projections 3 facing up using suitable carrier section, which may be constituted by an X-Y robot 13 in the illustrated embodiment. Subsequently, the dish-shaped metal springs 5 are each pressed against the pressing projection 3 corresponding thereto while aligning a central portion of the pressing projection 3 with an apex of the dish-shaped metal spring 5 by means of a cover positioning and carrying jig 21. This results in the dish-shaped metal spring 5 being fixedly bonded to the pressing projection 3 of the cover sheet 1 through the adhesive section 6.

More specifically, the adhesive applying section 11 includes a dispenser, which applies an adhesive in a predetermined amount to each of the pressing projections 3 for every key. Then, the cover sheet 1 thus formed thereon with the adhesive sections 6 is carried while keeping the pressing projections 3 facing up by means of the X-Y robot 13. Thereafter, the dish-shaped metal springs 5 are each fed directly to the pressing projection 3 corresponding thereto by means of the image processing section 12 and a high-precision index section 16, so that the dish-shaped metal spring 5 may be adhesively fixed at an apex of a central portion thereof on the pressing projection 3 with high accuracy. This permits positional deviation between the dish-shaped metal spring 5 and the cover sheet 1 to be within a range as small as ±0.05 mm.

In this instance, the dish-shaped metal springs 5 are each suckedly held on a respective one of suction arms 18 equipped with a lifting mechanism and mounted on a table 17 driven by the high-precision index section 16 connected to a drive servomotor 14 and a reducer 15 while keeping the apex of the dish-shaped metal spring 5 facing outwardly. Then, the dish-shaped metal springs 5 are each separated from a dish-shaped metal spring hoop 20 by punching as shown in FIG. 3 and then carried to a dish-shaped metal spring bonding position 19 while being kept lifted. In the meantime, the cover sheet 1 having the adhesive applied thereto is positioned with high accuracy so that the pressing projections 3 of the cover sheet 1 may be right below a corresponding one of the suction arms 18 using the X-Y robot 13 and image processing section 12. Then, after it is confirmed that the pressing projections 3 are placed right below the suction arms 18, the suction arms 18 each having the dish-shaped metal spring 5 suckedly held thereon are lowered to forcedly bond the dish-shaped metal springs 5 to the pressing projections 3 of the adhesive-deposited cover sheet 1. Then, the dish-shaped metal springs 5 are released from suction by the suction arms 18, which is then upwardly moved. Then, the cover sheet 1 having the dish-shaped metal springs 5 thus mounted thereon is left to stand at a normal temperature, resulting in the dish-shaped metal springs 5 being firmly fixed to the cover sheet 1. Such operation permits the dish-shaped metal springs 5 to be adhesively fixed to the pressing projections 3 of the cover sheet 1 with high accuracy, so that the push button switch cover 4 of the illustrated embodiment may be manufactured at an increased speed.

In the illustrated embodiment, positional deviation between the pressing projections 3 of the cover sheet 1 and the dish-shaped metal springs 5 is quantitatively inspected or detected through the image processing section 12, so that the push button switch cover 4 which is substantially free of any positional deviation and which exhibits uniform quality may be manufactured with high positional accuracy. Also, this eliminates a step of superposing the push button switch cover and a spring fixing pressure-sensitive adhesive sheet on each other which is required in the prior art.

An adhesive for the adhesive section 6 for bonding the dish-shaped metal spring 5 to the pressing projection 3 is not limited to any specific one so long as it is increased in bonding strength and reduced in change, such as cold flow, migration or the like, with time. However, a silicone adhesive of the moisture-curing type is effectively used for this purpose in view of prevention of the positional deviation after the bonding and when the push button switch cover 4 is made of silicone rubber.

Further, the adhesive may be of the dry type. Also, it may be applied to not only the pressing projections 3 of the cover sheet 1 but the dish-shaped metal springs 5, resulting in joining therebetween being attained while keeping the adhesive semi-cured, leading to an increase in bonding strength.

The pressing projections 3 may each have a joint surface formed to be flat. Alternatively, the joint surface may be formed to have a concave or curved shape so as to conform to a dome-like shape of the dish-shaped metal spring 5, resulting in the above-described positional deviation being prevented and the adhesive applied thereto being effectively held.

As can be seen form the foregoing, the push button switch cover of the illustrated embodiment is so constructed that the dish-shaped metal springs 5 are bonded to the pressing projections 3 of the cover sheet 1 by means of an adhesive. Such construction substantially enhances accuracy with which positioning between the dish-shaped metal springs and the cover sheet or pressing projections is carried out, resulting in keying load characteristics of the push button switch cover being significantly stabilized. Also, such construction eliminates arrangement of any spring fixing pressure-sensitive adhesive sheet and PET sheet which is required in the prior art, leading to a reduction in manufacturing cost.

In addition, manufacturing of the push button switch cover of the illustrated embodiment permits positional deviation between the pressing projections 3 of the cover sheet 1 and the dish-shaped metal springs 5 to be positively inspected. Also, the push button switch cover provided by the illustrated embodiment is increased in productivity and reduced in manufacturing cost.

Figure 5A:
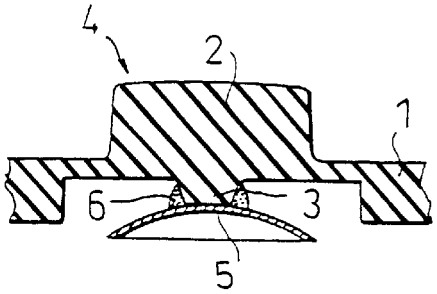
FIG. 5A is a fragmentary vertical sectional view showing another embodiment of a push button switch cover according to the present invention.
Figure 5B:
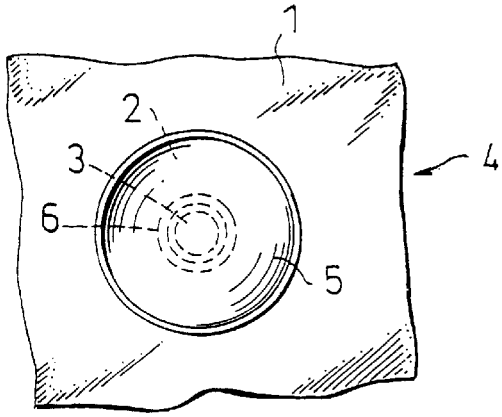
FIG. 5B is a fragmentary bottom view of the push button switch cover shown in FIG. 5A.

Referring now to FIGS. 5A and 5B, a second embodiment of a push button switch cover according to the present invention is illustrated. A push button switch cover 4 of the illustrated embodiment likewise includes a cover sheet or substrate 1, which is formed on a front surface thereof with key tops 2. The key tops 2 each include a display section (not shown) such as a character, a symbol, a pictograph, a picture or the like. The cover sheet 1 is formed on a rear surface thereof with pressing projections 3 in a manner to positionally correspond to the key tops 2. The push button switch cover 4 also includes dish-shaped metal springs 5 arranged so as to correspond to the pressing projections 3, respectively. Each of the dish-shaped metal springs 5 is arranged in a manner to be abutted at an apex thereof against a central portion or region of the pressing projection 3 corresponding thereto and is fixed on the pressing projection 3 through an elastic adhesive section 6.

The illustrated embodiment is constructed so as to minimize compressive deformation of the pressing projections 3 of the cover sheet 1 and substantially prevent detachment of joint surfaces due to repeated switching operations. For this purpose, the adhesive section 6 is made of an elastic adhesive such as a polyether-modified adhesive containing a silyl group, so that the dish-shaped metal springs 5 are adhesively fixed to the pressing projections 3 of the cover sheet 1 through the thus-formed elastic adhesive sections 6. To this end, the elastic adhesive preferably has a hardness within a range of ±20 (Shore hardness A) based on a hardness of the cover sheet 1.

In particular, in order to prevent spreading of the adhesive during application of the elastic adhesive to the pressing projections 3 of the cover sheet 1, fixing of the dish-shaped metal spring 5 to the pressing projection 3 is carried out by bonding using an elastic adhesive of 20 to 150 Pa·s in initial viscosity, 20 to 90 in Shore A hardness and 75 to 700% in elongation. Also, the elastic adhesive contains a main adhesive ingredient, as well as an additive silicone adhesive ingredient in a predetermined amount which silicone adhesive is different from the main adhesive ingredient in order to enhance physical characteristics such as click feeling and repeat characteristics. Such composition permits the elastic adhesive to exhibit increased bonding force and strength. Thus, the main adhesive ingredient of the adhesive for the elastic adhesive section 6 may be selected from the group consisting of an epoxy adhesive, a modified adhesive of the polyol type containing a silyl group, a cyanoacrylate adhesive, a polyester adhesive and a silicone adhesive. Preferably, it may be selected from the group consisting of a moisture-curing adhesive, a thermosetting adhesive and an ultraviolet-curing adhesive. More preferably, a moisture-curing adhesive is used for this purpose.

Now, the adhesive will be described more detailedly. When the dish-shaped metal spring 5 has a diameter of 4 mm-6 mm-8 mm and the pressing projection 3 has a diameter of 2 mm-2.5 mm-3 mm, the adhesive applied is preferably 2 to 7 mg in an amount. The amount of adhesive above 7 mg causes a bonding area to be increased due to overflow or spreading of the adhesive, leading to a deterioration in click feeling and bonding durability. The amount below 2 mg causes the bonding area to be insufficient, resulting in both bonding durability and keying durability being deteriorated.

Also, in order to improve the positional accuracy, i.e., accuracy with which positioning between the pressing projections 3 and the dish-shaped metal springs 5 is carried out, the elastic adhesive preferably has an initial viscosity of 20 to 150 Pa·s.

The elastic adhesive has elongation set within a range between 75% and 700%. Such elongation permits the adhesive to exhibit satisfactory bonding durability when the adhesive is present in an amount of 2 to 7 mg. The amount of adhesive below 75% and above 700% leads to a deterioration in bonding durability of the adhesive. In this connection, the adhesive of which elongation is 700% exhibits bonding durability below an allowable lower limit when the amount is between 3 mg and 7 mg. Nevertheless, it exhibits stable bonding durability which permits it to withstand repeated operation over five hundred thousand (500,000) times. Thus, the adhesive of which elongation is between 75% and 700% may be used for disposable equipment such as a disposable camera, a disposable game unit or the like. However, the adhesive of 75 to 250% in elongation is preferably used for precision electronic equipment or portable terminal equipment such as a mobile phone, a handy terminal, a PDA or the like which is required to exhibit increased durability and reliability.

The amount of adhesive is determined essentially depending on a size of the pressing projection 3 or a diameter thereof. An area of the dish-shaped metal spring 5 to which the adhesive is applied is desirably as small as possible in view of a deterioration in impact resilience of the dish-shaped metal spring 5. Also, determination of the amount of adhesive applied somewhat depends on a diameter of the dish-shaped metal spring 5, a degree of curve thereof and an angle of rising thereof. When the dish-shaped metal spring 5 is formed to have an increased diameter while being kept at a gentle doom-like shape, application of the adhesive in a relatively large amount to an apex of the doom does not cause pressing operation to be significantly deteriorated. A combination of parts of the push button switch cover of the illustrated embodiment is not substantially restricted. However, actually it will be required to consider a variation in quantity of adhesive discharged from a dispenser of an adhesive applicator. Thus, a test carried out on a combination of the dish-shaped metal spring 5 of 4 to 6 mm in diameter and the pressing projection 3 having a diameter between 2 mm and 3 mm revealed that the amount of adhesive suitable in the illustrated embodiment is 2 to 7 mg. When the pressing projection 3 has a diameter of 2 mm, the adhesive is preferably 2 to 4 mg in an amount. When the former is 3 mm in diameter, the latter is preferably 5 to 7 mg.

Figure 6:
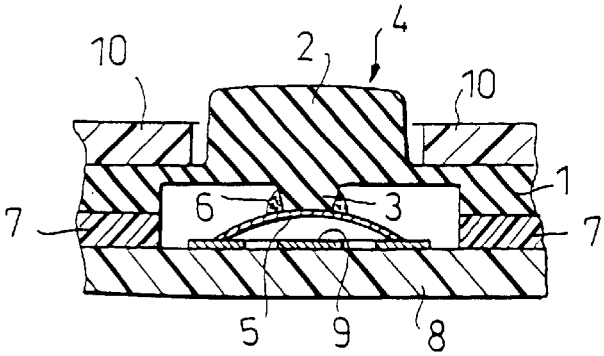
FIG. 6 is a fragmentary vertical sectional view showing the push button switch cover of FIG. 5A incorporated in a push button switch.
Figure 7A:
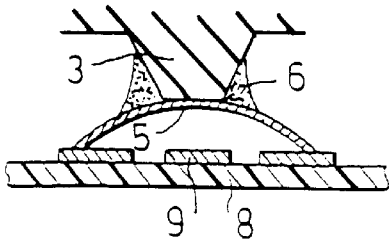
FIGS. 7A to 7C each are a fragmentary schematic sectional view showing buckling of the push button switch cover shown in FIG. 5A.
Figure 7B:
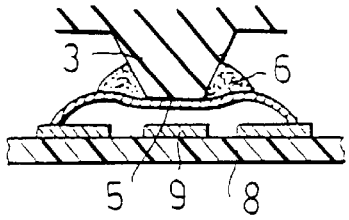
Figure 7C:
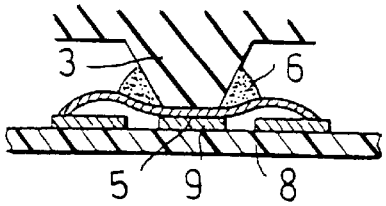

In the illustrated embodiment, the push button switch cover 4 having the dish-shaped metal springs 5 fixed thereon, as shown in FIG. 6, is mounted through a spacer 7 arranged as required on a circuit board 8 so as to be positioned above fixed contacts 9 and then received in a casing 10 of an equipment such as a mobile phone, resulting in functioning as a push button switch unit.

The spacer 7 may be formed to have a thickness sufficient to permit click feeling to be adjusted as desired. However, arrangement of the spacer 7 is not necessarily required so long as a base section of the cover sheet 1 is formed to have a thickness sufficient to ensure satisfactory pressing operation.

The cover sheet or substrate 1 may be made of a synthetic rubber material such as silicone rubber, EPDM or the like, a thermoplastic elastomer such as polyester, polyurethane, polyolefine or polystyrene, or other resin material by any suitable techniques such as injection molding, compression molding or the like.

The key tops 2 of the cover sheet 1 are arranged so as to be outwardly projected from the casing 10, resulting in the key tops 2 functioning as a press operation section by an operator.

The pressing projection 3 may be formed integrally with or separately from the cover sheet 1. It may be made of a material selected from the group consisting of a silicone rubber material and an elastomer material, as well as a thermosetting resin material and a thermoplastic resin material. Thus, it may be made of a resin material such as, for example, ABS, PS, PC, PET, PP, PA, POM, PBT or the like.

Figure 2:
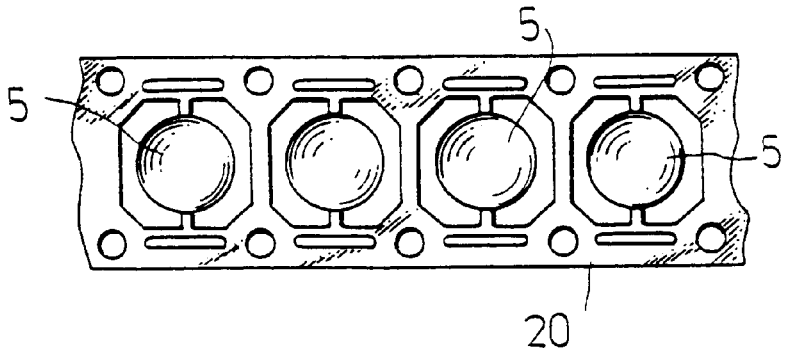
FIG. 2 is a fragmentary plan view showing a dish-shaped metal spring hoop used in manufacturing of a push button switch cover according to the present invention.
Figure 3:
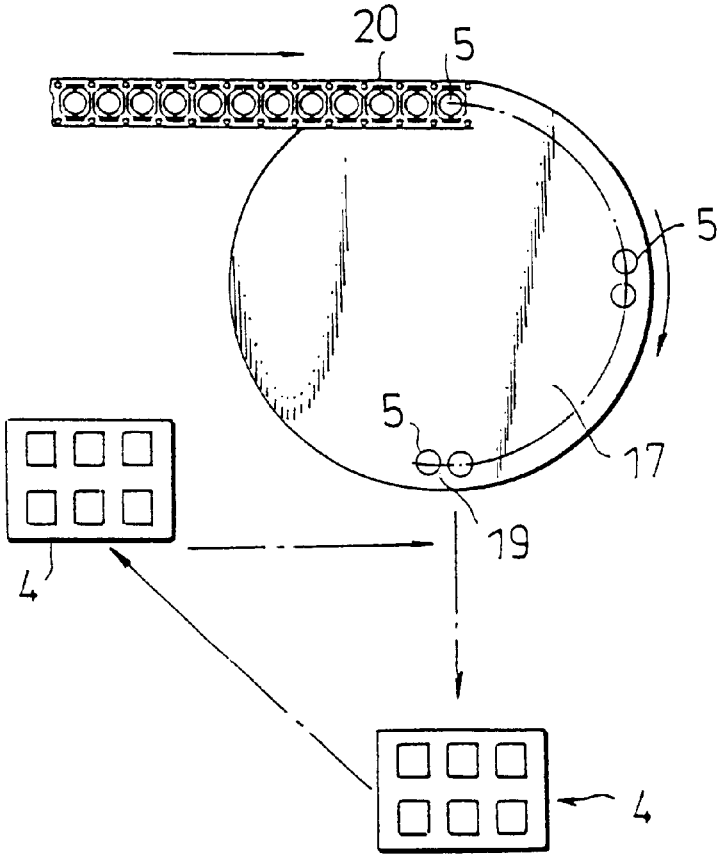
FIG. 3 is a schematic view showing a step of fixing dish-shaped metal springs by bonding in manufacturing of a push button switch cover according to the present invention.
Figure 4:
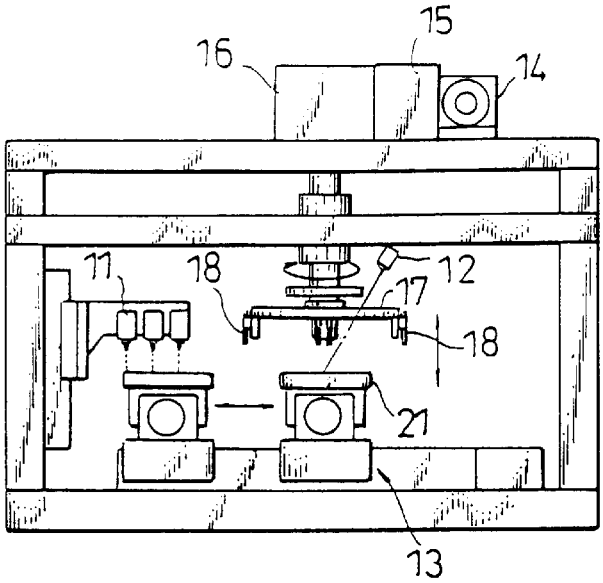
FIG. 4 is a schematic side elevation view showing a unit for fixing dish-shaped metal springs which is suitable for use in the step shown in FIG. 3 by way of example.

Manufacturing of the push button switch cover 4 of the illustrated embodiment thus constructed is carried out in the same manner as that shown in FIGS. 2 to 4 with reference to the embodiment of FIGS. 1A to 1C.

The adhesive for the elastic adhesive section 6 may contain a silyl group. However, it is not limited to any specific one so long as it is increased in bonding strength and reduced in change with time, such as cold flow, migration or the like. Nevertheless, a silicone adhesive of the moisture-curing type may be effectively used for this purpose in view of prevention of the positional deviation after the bonding and when the cover sheet 1 is made of silicone rubber.

For example, when the dish-shaped metal spring 5 is made of SUS 301, SUS 303 or SUS 304 stainless steel, the key top 2 is made of silicone rubber or resin such as PC, PS or ABS and the cover sheet 1 is made of silicone rubber, the adhesive for the elastic adhesive section 6 may be selected from Table 1 in view of elongation set within the above-described range.

The elongation (%) of the adhesive is determined according to a procedure defined in JIS K 6301 wherein the adhesive is formed to have a dumbbell specimen (Type No. 2). A length or distance between bench marks on the specimen at the time when the specimen is broken due to application of tension thereto is measured and then the elongation is calculated according to the following equation:

$$EB=[(L1-L0)/L0]\times 100$$

wherein EB is an elongation (%), L0 is an initial distance (mm) between bench marks and L1 is a distance (mm) between the bench marks at the time of breaking of the specimen.

TABLE 1

Repeat Durability of Adhesive

| | Characteristics | | | | | | |
|---|---|---|---|---|---|---|---|
| Adhesive | Hardness (JIS Shore A) | Elongation (JIS K 6301) (%) | Shearing Bonding Strength [Aluminum] (kgf/cm$^2$) | Reaction | Tensile Strength (kgf/cm$^2$) | Viscosity [25° C.] (Pa · s) | Repeat Durability (× 10,000 times) |
| KE-4897 | 30 | 180 | 15 | Condensation | 15 | 100 | 150 |
| KE-4896 | 30 | 150 | 12 | ↑ | 12 | 50 | 150 |
| KE-4895 | 30 | 100 | 10 | Condensation | 10 | 5 | 150 |
| KE-1820 | 40 | 650 | 25 | Thermal cure | 55 | Unmeasurable | 150 |
| KE-1823 | 20 | 700 | 5 | Condensation | 35 | Unmeasurable | 150 |
| KE-1825 | 29 | 600 | 20 | ↑ | 34 | Unmeasurable | 150 |
| KE-1842 | 10 | 230 | 2 | ↑ | 6 | 4 | 150 |
| KE-1254 | 30 | 220 | 5 | ↑ | 38 | 3 | 150 |
| TSE3212 | 52 | 240 | 27 | ↑ | 24 | 55 | 150 |
| TSE3221 | 28 | 290 | 20 | ↑ | 38 | 280 | 150 |
| TSE370 | 22 | 530 | 22 | Condensation | 25 | Unmeasurable | 150 |
| SE9175 | 30 | 500 | 15 | Thermal cure | 28 | 15 | |
| SE9176L | 23 | 320 | 8 | ↑ | 15 | 70 | |
| SE9186 | 21 | 470 | 14 | ↑ | 21 | 1 | |
| SE9187L | 17 | 180 | 3 | ↑ | 4 | Unmeasurable | |
| SE9184 | 65 | 75 | 20 | ↑ | 31 | 25 | |

TABLE 1-continued

| Repeat Durability of Adhesive | | | | | | | |
|---|---|---|---|---|---|---|---|
| | Characteristics | | | | | | |
| Adhesive | Hardness (JIS Shore A) | Elongation (JIS K 6301) (%) | Shearing Bonding Strength [Aluminum] (kgf/cm$^2$) | Reaction | Tensile Strength (kgf/cm$^2$) | Viscosity [25° C.] (Pa · s) | Repeat Durability (× 10,000 times) |
| SE9189L | 30 | 240 | 11 | ↑ | 16 | Unmeasurable | |
| SE737 | 25 | 500 | 10 | ↑ | 15 | Unmeasurable | |
| SE739 | 25 | 550 | 11 | ↑ | 15 | 13 | |
| CY51-019 | 27 | 220 | 10 | ↑ | 10 | 13 | |
| CY51-038 | 36 | 150 | 10 | ↑ | 15 | 4 | |
| SE1701 | 65 | 200 | 32 | Thermal cure | 75 | 80 | |
| SUPER X8008 WHITE | 42 | 215 | 40 | Condensation | 34 | 100 | 150 |
| SUPER X8008 B/L | 34 | 200 | 35 | ↑ | 35 | 24 | 150 |
| SUPER X8008 BLACK | 42 | 215 | 40 | ↑ | 29 | 100 | |
| SUPER X8008 CLEAR | 30 | 150 | 38 | ↑ | 21 | 80 | |
| SX720W | 59 | 150 | 33 | Condensation | 28 | 45 | 150 |

KE: Shin-Etsu Chemical Co., Ltd.
SE: Dow Corning Toray Silicone Co., Ltd.
TSE: Toshiba Silicone Co., Ltd.
SUPER X, SX: Cemedine Co.
CY: Wacker Chemicals East Asia Ltd.

A difference in click feeling among the adhesives due to a difference in elongation is not observed. However, the adhesives reduced in elongation should not be used because of being deteriorated in bonding durability and keying durability.

The elastic adhesive may be solely used. Alternatively, it may be used as a main adhesive ingredient, which is combined with a silicone adhesive ingredient different from the main adhesive ingredient. The silicone adhesive ingredient is added in a predetermined amount based on 100 parts by weight of the main adhesive ingredient, to thereby permit elongation to be varied as desired as shown in Tables 2 and 3, resulting in keying durability being further enhanced. The silicone adhesive ingredient may be added in an amount of 5 to 50 parts by weight.

TABLE 2

| Variation in Elongation by Addition of Silicone Adhesive | | | | | |
|---|---|---|---|---|---|
| | Elongation [JIS K 6301] (%) Silicone Adhesive Ingredient Added | | | | |
| Main Adhesive Ingredient | No Addition | Super X8008 White of 5 parts by weight | Super X8008 White of 20 parts by weight | Super X8008 White of 50 parts by weight | Super X8008 White of 100 parts by weight |
| KE-4897 | 180 | 180 | 190 | 240 | 300 |
| KE-4896 | 150 | 150 | 170 | 180 | 230 |
| KE-4895 | 100 | 100 | 130 | 130 | 200 |
| KE-1820 | 650 | 650 | 650 | 650 | 700 |
| KE-1823 | 700 | 700 | 660 | 660 | 710 |
| KE-1825 | 600 | 600 | 550 | 550 | 600 |
| KE-1842 | 230 | 230 | 200 | 200 | 230 |
| KE-1254 | 220 | 220 | 220 | 220 | 250 |

TABLE 2-continued

| Variation in Elongation by Addition of Silicone Adhesive | | | | | |
|---|---|---|---|---|---|
| | Elongation [JIS K 6301] (%) Silicone Adhesive Ingredient Added | | | | |
| Main Adhesive Ingredient | No Addition | Super X8008 White of 5 parts by weight | Super X8008 White of 20 parts by weight | Super X8008 White of 50 parts by weight | Super X8008 White of 100 parts by weight |
| TSE3212 | 240 | 240 | 280 | 280 | 320 |
| TSE3221 | 290 | 290 | 300 | 300 | 350 |
| TSE370 | 530 | 530 | 530 | 530 | 600 |
| SE9175 | 500 | 500 | 550 | 550 | 410 |
| SE9176L | 320 | 320 | 330 | 360 | 380 |
| SE9186 | 470 | 470 | 470 | 470 | 510 |
| SE9187L | 180 | 180 | 250 | 250 | 250 |
| SE9184 | 75 | 75 | 110 | 110 | 110 |
| SE9189L | 240 | 240 | 230 | 230 | 230 |
| SE737 | 500 | 500 | 500 | 500 | 510 |
| SE739 | 550 | 550 | 550 | 550 | 570 |
| CY51-019 | 220 | 220 | 210 | 210 | 230 |
| CY51-038 | 150 | 150 | 180 | 180 | 190 |
| SE1701 | 200 | 200 | 210 | 210 | 220 |

TABLE 3

| Characteristics Obtained by Adding Silicone Adhesive Ingredient to Main Adhesive Ingredient | | | | |
|---|---|---|---|---|
| Spring Diameter (mm) | Amount of Adhesive (mg) | Click Ratio (%) | Keying Durability × (10,000 times) | Bonding Durability × (10,000 times) |
| 3 | 4 | 31→40 | 75→125 | 125 |
| 4 | 4 | 33→40 | 100→150 | 150 |
| 5 | 5 | 34→41 | 100→150 | 150 |
| 6 | 5 | 37→43 | 100→150 | 150 |
| 7 | 5 | 40→48 | 100→150 | 150 |
| 8 | 5 | 51→55 | 100→150 | 150 |
| 9 | 5 | 31→36 | 100→125 | 150 |
| 10 | 5 | 33→35 | 100→125 | 150 |
| 11 | 5 | 38→41 | 100→125 | 150 |
| 12 | 5 | 36→41 | 100→125 | 150 |

The silicone adhesive ingredient in an amount of 20 parts by weight was added to the main adhesive ingredient Super X8008B/L which is a polyether-modified adhesive containing a silyl group and has a viscosity of 24 Pa · s and an elongation of 200%. The values of "click ratio" and "keying durability" indicated to the left of the arrows are those for only the main adhesive ingredient (i.e., without addition of the silicone adhesive ingredient) and the values indicated to the right of the arrows are those when the silicone adhesive ingredient is added to the main adhesive ingredient.

As will be noted from Table 3, addition of the silicone adhesive to the elastic adhesive Super X8008 B/L acting as the main adhesive ingredient permits the elongation to be increased, to thereby realize that stress to the bonding interface due to repeated deformation of the dish-shaped metal spring and pressing projection is effectively absorbed, leading to an increase in durability. Also, the elongation within a range between of 75% and 700% is possible, however, it is preferable between 95% and 700% in view of a compound balance between the main adhesive ingredient and the silicone adhesive.

Tables 4A to 4D show the basis on which the adhesive is applied in an amount of 2 to 7 mg. The amount of the adhesive is determined on the basis of, for example, the amount of the adhesive for the dish-shaped metal spring of 5 mm in diameter and pressing projection of 2 mm in diameter, i.e., determined by multiplying the basic amount by a coefficient proportional to a diameter, supposing that the ratio of the diameters of the dish-shaped metal spring and pressing projection is a substantially constant.

TABLE 4A

| Bonding Durability due to Variation in Amount of Applied Adhesive | | | | | | |
|---|---|---|---|---|---|---|
| Amount of Adhesive (mg) | Peak Load (gf) | Make Load (gf) | Make Stroke (mm) | Click Ratio (%) | Keying Durability (x 10,000 times) | Bonding Durability (x 10,000 times) |
| Before Bonding to Cover Sheet (Dish-shaped Metal Spring Proper) | | | | | | |
| — | 155 | 94 | 0.19 | 39 | 150 | — |
| Dish-shaped Metal Spring Bonded to Cover Sheet | | | | | | |
| 2 | 243 | 160 | 0.39 | 34 | 150 | 100 |
| 3 | 247 | 155 | 0.35 | 37 | 150 | 150 |
| 4 | 250 | 155 | 0.33 | 38 | 150 | 150 |
| 5 | 254 | 157 | 0.31 | 38 | 150 | 150 |

TABLE 4A-continued

| Bonding Durability due to Variation in Amount of Applied Adhesive | | | | | | |
|---|---|---|---|---|---|---|
| Amount of Adhesive (mg) | Peak Load (gf) | Make Load (gf) | Make Stroke (mm) | Click Ratio (%) | Keying Durability (x 10,000 times) | Bonding Durability (x 10,000 times) |
| 6 | 265 | 180 | 0.28 | 32 | 75 | 150 |
| 7 | 275 | 206 | 0.26 | 25 | 75 | 150 |

Diameter of Pressing Projection: 2 mm

Diameter of Dish-shaped Metal Spring: 5 mm

Adhesive: Polyether-Modified Adhesive Containing Silyl Group, Super X8008 White (Elongation: 215%)

An increase in amount of the adhesive causes an increase in pressing load, thus, a reduction in click ratio with a reduction in stroke is noticed. Also, a variation in amount of the adhesive affects bonding durability of the adhesive and repeat durability of the dish-shaped metal spring. More particularly, the amount of the adhesive below 2 mg causes a deterioration in bonding durability of the adhesive and the amount of the adhesive above 7 mg leads to a deterioration in repeat durability of the dish-shaped metal spring.

TABLE 4B

| Bonding Durability due to Variation in Amount of Applied Adhesive | | | | | | |
|---|---|---|---|---|---|---|
| Amount of Adhesive (mg) | Peak Load (gf) | Make Load (gf) | Make Stroke (mm) | Click Ratio (%) | Keying Durability (x 10,000 times) | Bonding Durability (x 10,000 times) |
| Before Bonding to Cover Sheet (Dish-shaped Metal Spring Proper) | | | | | | |
| — | 160 | 96 | 0.19 | 40 | 150 | — |
| Dish-shaped Metal Spring Bonded to Cover Sheet | | | | | | |
| 2 | 248 | 164 | 0.38 | 34 | 150 | 75 |
| 3 | 251 | 155 | 0.34 | 38 | 150 | 100 |
| 4 | 251 | 153 | 0.33 | 39 | 150 | 150 |
| 5 | 254 | 152 | 0.32 | 40 | 150 | 150 |
| 6 | 260 | 171 | 0.30 | 34 | 100 | 150 |
| 7 | 265 | 186 | 0.27 | 30 | 75 | 150 |

Diameter of Pressing Projection: 2 mm
Diameter of Dish-shaped Metal Spring: 5 mm
Adhesive: Polyether-Modified Adhesive Containing Silyl Group, Super X8008 Clear (Elongation: 75%(minimum))

Table 4B indicates that pressing load characteristics are varied depending on the amount of the adhesive. Also, bonding durability of the adhesive and repeat durability of the dish-shaped metal spring are affected by the amount of the adhesive. More specifically, the amount of the adhesive below 2 mg leads to a deterioration in bonding durability of the adhesive and the amount of the adhesive above 7 mg causes repeat durability of the dish-shaped metal spring to be deteriorated.

TABLE 4C

Bonding Durability due to Variation in Amount of Applied Adhesive

| Amount of Adhesive (mg) | Peak Load (gf) | Make Load (gf) | Make Stroke (mm) | Click Ratio (%) | Keying Durability (x 10,000 times) | Bonding Durability (x 10,000 times) |
|---|---|---|---|---|---|---|
| Before Bonding to Cover Sheet (Dish-shaped Metal Spring Proper) | | | | | | |
| — | 155 | 94 | 0.19 | 39 | 150 | — |
| Dish-shaped Metal Spring Bonded to Cover Sheet | | | | | | |
| 2 | 240 | 156 | 0.38 | 35 | 150 | 25 |
| 3 | 250 | 155 | 0.34 | 38 | 150 | 75 |
| 4 | 253 | 154 | 0.31 | 39 | 150 | 75 |
| 5 | 253 | 157 | 0.31 | 38 | 150 | 75 |
| 6 | 254 | 157 | 0.31 | 38 | 150 | 75 |
| 7 | 260 | 182 | 0.28 | 30 | 150 | 75 |

Diameter of Pressing Projection: 2 mm
Diameter of Dish-shaped Metal Spring: 5 mm
Adhesive: Silicone Adhesive, KE-1823 (Elongation: 700% (maximum))

Table 4C indicates that pressing load characteristics are varied depending on the amount of the adhesive. Bonding durability of the adhesive is substantially deteriorated as regards this type of the adhesive. Bonding durability is reduced to a level as low as 750,000 times irrespective of the amount of the adhesive. The amount of the adhesive below 2 mg causes performance of the adhesive or bonding durability of thereof to be reduced to a level as low as 250,000 times.

TABLE 4D

Bonding Durability due to Variation in Amount of Applied Adhesive

| Amount of Adhesive (mg) | Peak Load (gf) | Make Load (gf) | Make Stroke (mm) | Click Ratio (%) | Keying Durability (x 10,000 times) | Bonding Durability (x 10,000 times) |
|---|---|---|---|---|---|---|
| Before Bonding to Cover Sheet (Dish-shaped Metal Spring Proper) | | | | | | |
| — | 158 | 80 | 0.2 | 39 | 150 | — |
| Dish-shaped Metal Spring Bonded to Cover Sheet | | | | | | |
| 2 | 250 | 170 | 0.39 | 32 | 150 | 75 |
| 3 | 255 | 150 | 0.35 | 39 | 150 | 150 |
| 4 | 257 | 157 | 0.34 | 39 | 150 | 150 |

TABLE 4D-continued

Bonding Durability due to Variation in Amount of Applied Adhesive

| Amount of Adhesive (mg) | Peak Load (gf) | Make Load (gf) | Make Stroke (mm) | Click Ratio (%) | Keying Durability (x 10,000 times) | Bonding Durability (x 10,000 times) |
|---|---|---|---|---|---|---|
| 5 | 255 | 160 | 0.33 | 37 | 150 | 150 |
| 6 | 260 | 161 | 0.32 | 38 | 75 | 150 |
| 7 | 267 | 179 | 0.27 | 33 | 25 | 150 |

Diameter of Pressing Projection: 2 mm
Diameter of Dish-shaped Metal Spring: 5 mm
Adhesive: Silicone Adhesive, SE9184 (Elongation: 75% (minimum))

Table 4D indicates that the amount of the adhesive affects bonding durability of the adhesive and repeat durability of the dish-shaped metal spring. The amount of the adhesive below 2 mg causes a deterioration in the bonding durability and the amount of the adhesive above 7 mg causes the repeat durability to be substantially reduced.

Tables 5A to 5C show relationship between elongation of the adhesive and the amount of the adhesive which affects characteristics of the push button switch cover such as, for example, a click ratio, keying durability and bonding durability, when the amount of adhesive is within the above-described range.

TABLE 5A

Click Ratio (%) (Depending on Elongation of Adhesive and Amount Thereof)

| Elongation (Adhesive) | | Amount of Adhesive 2 mg | 3 mg | 4 mg | 5 mg | 6 mg | 7 mg | 8 mg |
|---|---|---|---|---|---|---|---|---|
| 215% | (Super X8008) | 34 | 37 | 38 | 38 | 32 | 25 | 25 |
| 700% | (KE-1823) | 35 | 38 | 39 | 38 | 38 | 30 | 27 |
| 75% | (SE9184) | 32 | 39 | 39 | 37 | 38 | 33 | 28 |
| 0% | (Cyanoacrylate) | 34 | 35 | 30 | 34 | 34 | 34 | 34 |
| 290% | (TSE3221) | 33 | 37 | 37 | 38 | 37 | 36 | 32 |

Super X8008 of 215% in elongation and KE-1823 of 700% in elongation each cause a deterioration in feeling when it is present in an amount of 7 mg or more.

TABLE 5B

Keying Durability (× 10,000 times) (Depending on Elongation of Adhesive and Amount Thereof)

| Elongation (Adhesive) | | Amount of Adhesive 2 mg | 3 mg | 4 mg | 5 mg | 6 mg | 7 mg | 8 mg |
|---|---|---|---|---|---|---|---|---|
| 215% | (Super X8008) | 150 | 150 | 150 | 150 | 75 | 75 | 75 |
| 700% | (KE-1823) | 150 | 150 | 150 | 150 | 150 | 150 | 150 |
| 75% | (SE9184) | 150 | 150 | 150 | 150 | 75 | 25 | 25 |
| 0% | (Cyanoacrylate) | 0.005 | 0.003 | 0.005 | 0.008 | 0.005 | 0.001 | 0.001 |
| 290% | (TSE3221) | 150 | 150 | 150 | 150 | 100 | 100 | 50 |

Table 5B indicates that SE9184 adhesive of 75% in elongation adversely affects keying durability when it is present in an amount of 6 mg or more and the cyanoacrylate adhesive of 0% in elongation fully deteriorates keying durability.

TABLE 5C

Bonding Durability (× 10,000 times) (Depending on Elongation of Adhesive and Amount Thereof)

| Elongation (Adhesive) | | Amount of Adhesive 2 mg | 3 mg | 4 mg | 5 mg | 6 mg | 7 mg | 8 mg |
|---|---|---|---|---|---|---|---|---|
| 215% | (Super X8008) | 100 | 150 | 150 | 150 | 150 | 150 | 150 |
| 700% | (KE-1823) | 25 | 75 | 75 | 75 | 75 | 75 | 25 |
| 75% | (SE9184) | 75 | 150 | 150 | 150 | 150 | 150 | 75 |
| 0% | (Cyanoacrylate) | 0.005 | 0.003 | 0.005 | 0.008 | 0.005 | 0.002 | 0.002 |
| 290% | (TSE3221) | 150 | 150 | 150 | 150 | 150 | 150 | 100 |

The adhesives which are excessively increased or reduced in elongation are deteriorated in bonding durability. In particular, the adhesives having no elongation (0%) exhibit no bonding durability.

Figure 8:
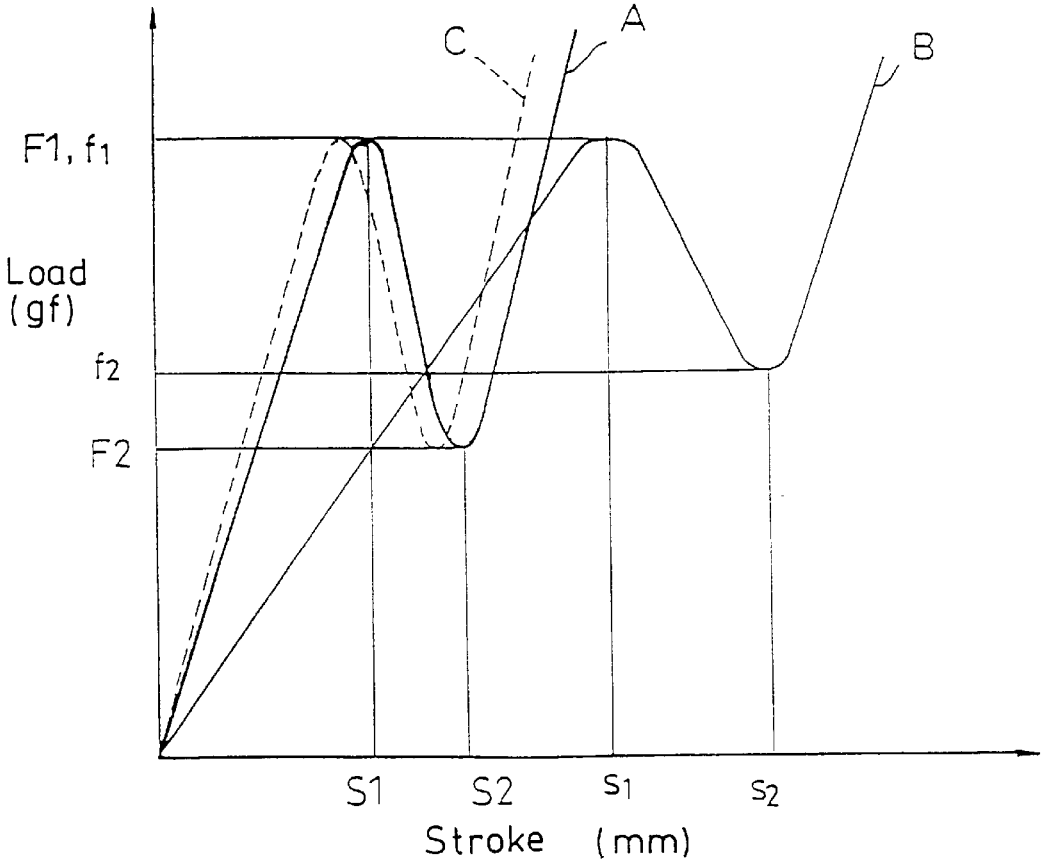
FIG. 8 is a graphical representation showing pressing load and a stroke in operation of the push button switch cover shown in FIG. 5A.

As to a difference in feeling among the adhesives, when the amount of the adhesive is insufficient or below 2 mg, a make stroke is increased as shown in FIG. 8. When it is excessive or above 7 mg, a make stroke is reduced to lower a click ratio and deteriorate bonding durability and functional durability. Thus, the amount of the adhesive is determined as described above.

Further, the adhesive may be of the dry type. It may be applied to not only the pressing projections 3 but the dish-shaped metal springs 5, followed by joining together after the adhesive semi-cured, leading to an increase in bonding strength of the adhesive.

The pressing projections 3 each may have a joint surface formed to be flat. Alternatively, the joint surface may be formed to have a concave or curved shape so as to conform to a dome-like shape of the dish-shaped metal spring 5, resulting in the above-described positional deviation being prevented and the adhesive applied thereto being effectively held.

Figure 9A:
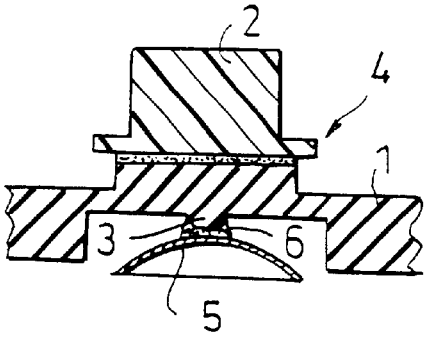
FIGS. 9A and 9B each are a fragmentary enlarged vertical sectional view showing a further embodiment of a push button switch cover according to the present invention.
Figure 9B:
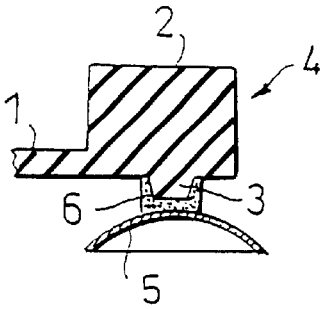

Referring now to FIG. 9A, a third embodiment of a push button switch cover according to the present invention is illustrated. A push button switch cover of the illustrated embodiment is so constructed that key tops 2 made of resin are bonded to a front surface of a cover sheet 1 and dish-shaped metal springs 5 are each fixed to a pressing projection 3 corresponding thereto through an elastic adhesive section 6. Alternatively, as shown in FIG. 9B, the key tops 2 may be formed of silicone rubber or silicone resin in a manner to be integral with the cover sheet 1, resulting in the push button switch cover being constructed into a hinge key type structure.

Figure 10:
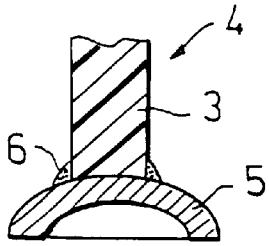
FIG. 10 is a fragmentary enlarged vertical sectional view showing still another embodiment of a push button switch cover according to the present invention.
Figure 11:
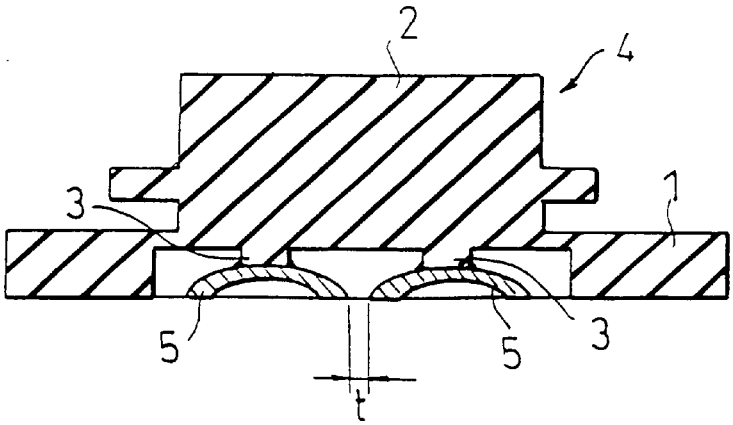
FIG. 11 is an enlarged vertical sectional view showing still another embodiment of a push button switch cover according to the present invention.
Figure 12:
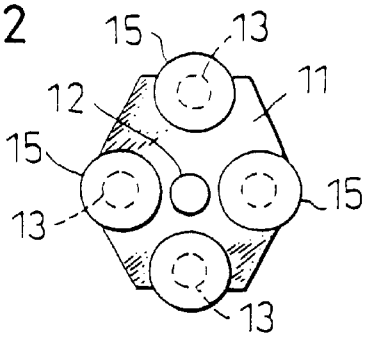
FIG. 12 is a plan view showing yet another embodiment of a push button switch cover according to the present invention.

Referring now to FIG. 10, a fourth embodiment of a push button switch cover according to the present invention is illustrated. A push button switch cover shown in FIG. 10 is directed to a mechanical switch, a tact switch or the like and includes only pressing projections 3 made of ABS, PS, PC, PET, PP, PA, POM, PBT, PO or the like. Alternatively, the push button switch cover may be constructed as shown in FIG. 11. More particularly, it is constructed into the dish-shaped metal spring bonded type wherein dish-shaped metal springs 5 arranged at a minute interval t (0.2 mm) are bonded directly to projections of a cover sheet 1. Also, the push button switch cover of the illustrated embodiment may be modified as shown in FIG. 12. A modification is constructed in the form of a scroll key for a four-direction operation switch used in a mobile phone serving as an information terminal for an internet or information equipment for a navigation system. More particularly, four such dish-shaped metal springs 15 are arranged around a central column 12 of a cover substrate 11 and fixed to pressing projections 13 by means of an elastic adhesive. The push button switch cover of the modification may provide a miniaturized switch wherein the dish-shaped metal springs 5 are formed to have a diameter of 5 mm and key intervals are set to be 5 mm or less.

In each of the illustrated embodiments, fixing of the dish-shaped metal springs to the pressing projections of the cover sheet may be carried out by means of an elastic adhesive, such as a polyether-modified adhesive containing a silyl group, a cyanoacrylate adhesive, a polyester adhesive or a silicone adhesive, to thereby provide a push button switch cover which exhibits clear operation feeling.

The dish-shaped metal spring may be made of SUS stainless steel or phosphor bronze and formed to have a diameter of 3 to 12 mm and a dome height of 0.1 to 0.4 mm wherein a buckling portion is arranged at a position of 25 to 95% based on the dome height from a top of the dome. The thus-formed dish-shaped metal spring is bonded to the pressing projection of 1.0 to 3.0 mm in diameter by means of the adhesive.

An effect of the amount of the elastic adhesive on keying durability of the push button switch cover of the present invention was tested by means of pressing force measuring equipment commercially available under a tradename Model-1613 from Aiko Engineering Co., Ltd. and repeat durability testing equipment manufactured by Shin-Etsu Polymer Co., Ltd. In the test, click feeling, repeat durability and bonding durability were evaluated while the diameters of the pressing projections of the cover substrate and the dish-shaped metal springs were set at 2 mm and 5 mm, respectively and the amount of the adhesive was 2 to 7 mg. The amount of the adhesive below 2 mg caused repeat durability of the push button switch cover to be as low as 50,000 times, a click ratio thereof to be 34% and a make stroke thereof to be 0.39 mm. Thus, the push button switch cover had a click ratio reduced by 5% and a make stroke increased by 0.2 mm as compared with the dish-shaped metal spring per se. The amount of the adhesive above 7 mg caused an excessive increase in peak load and a reduction in repeat durability to a level as low as 250,000 times. Thus, it will be noted that the amount of the adhesive between 2 mg and 7 mg is most suitable in view of click feeling, repeat durability and bonding durability.

Also, in order to ensure stable positional accuracy and stable angular accuracy of the dish-shaped metal spring and enhance fixing between the dish-shaped metal spring and the pressing projection with stable accuracy, the elastic adhesive is desirably has an initial viscosity of 20 to 150 Pa·s and preferably 30 to 100 Pa·s, because an excessive increase or excessive reduction in the viscosity of the elastic adhesive causes the dish-shaped metal spring to be positionally deviated even when the elastic adhesive section is arranged at an appropriate position. For example, when the dish-shaped metal spring is formed to have a spherical shape or a three-dimensional configuration and the pressing projection is formed to have a flat top surface, abutment between both is carried out by point contact. Thus, in order to attain fixing between the pressing projection and the dish-shaped metal spring with stable positional accuracy, it is required that the elastic adhesive have an ideal viscosity. It was found that adhesives having ideal viscosities which are shown in Table 6B permit stability of the dish-shaped metal spring to be ensured with stable positional accuracy by arranging the dish-shaped metal spring while keeping it from being inclined.

TABLE 6A

Stability of Dish-shaped Metal Spring Bonded to Cover Sheet

| Deviation | | Characteristics | | |
|---|---|---|---|---|
| XY Accuracy (mm) | Inclination (degree) | Peak Load (gf) | Make Stroke (mm) | Click Ratio (%) |
| 0 | 0 | 215 | 0.35 | 40 |
| 0 | 2.5 | 220 | 0.34 | 39 |
| 0.1 | 0 | 217 | 0.35 | 39 |
| 0.1 | 2.5 | 221 | 0.34 | 38 |
| 0.2 | 0 | 235 | 0.30 | 30 |
| 0.2 | 2.5 | 233 | 0.29 | 28 |
| 0.3 | 0 | 280 | 0.25 | 25 |
| 0.3 | 2.5 | 291 | 0.22 | 22 |
| 0.5 | 0 | 350 | 0.03 | 5 |
| 0.5 | 2.5 | 344 | 0.01 | 4 |

Passing and failing criteria were selected on the basis of the results shown in Table 6A. As to X-Y direction accuracy, the peak load and click ratio were increased and reduced above X-Y direction accuracy of 0.1 mm, respectively. This was likewise true of affection by the inclination above 2.5 degrees. Inclination of 2.5 degrees is a minimum value visually confirmed. Thus, passing or failing is determined on the basis of an X-Y direction accuracy maximum limit of 0.1 mm and an inclination accuracy limit of 2.5 degrees.

TABLE 6B

Stability Evaluation of Dish-shaped Metal Spring Depending on Viscosity of Adhesive

| Adhesive | | Compression Load 50 gf | | | | | Compression Load 130 gf | | | | |
|---|---|---|---|---|---|---|---|---|---|---|---|
| Viscosity (Pa · s) | | 5 | 24 | 100 | 150 | 280 | 5 | 24 | 100 | 150 | 280 |
| Adhesive | A | X | ○ | ○ | ○ | X | Δ | ○ | ○ | ○ | Δ |
| | B | X | ○ | ○ | ○ | X | Δ | ○ | ○ | ○ | Δ |
| | C | X | ○ | ○ | ○ | X | Δ | ○ | ○ | ○ | Δ |
| | D | X | ○ | ○ | ○ | Δ | Δ | ○ | ○ | ○ | ○ |

A: Cyanoacrylate adhesive
B: Polyester adhesive (including adhesive of the polyether-modified type containing a silyl group)
C: Silicone adhesive
D: Silicone-modified polymer adhesive
○: Both x-y accuracy and inclination of the dish-shaped metal spring satisfy the passing and failing criteria.
Δ: One of x-y accuracy and inclination of the dish-shaped metal spring satisfies the passing and failing criteria.
X: Neither x-y accuracy nor inclination of the dish-shaped metal spring satisfies the passing and failing criteria.

Table 7 given below shows the results of a test which was carried out mainly on a variation in bonding durability depending on a variation in the state of fixing of the dish-shaped metal spring to the pressing projection due to a difference in viscosity of the adhesive for the elastic adhesive section, using silyl-containing polyol-modified adhesives as examples.

TABLE 7

Durability Characteristics Based on Viscosity of Adhesive

| Viscosity of Adhesive (Pa.s) | Amount of Adhesive (mg) | Peak Load (gf) | Make Stroke (mm) | Click Ratio (%) | Repeat Durability (x 10,000 times) | Bonding Durability (x 10,000 times) |
|---|---|---|---|---|---|---|
| 24 | 4 | 251 | 0.35 | 38 | 150 | 175 |
| 5 to 10 | 4 | 251 | 0.38 | 34 | 150 | 15 |
| 160 | 4 | 251 | 0.44 | 27 | 150 | 50 |

Thus, the viscosity of the elastic adhesive between 20 Pa·s and 150 Pa·s permits results like those of the elastic adhesive having a viscosity of 24 Pa·s shown in Table 7 to be obtained. The elastic adhesive of such viscosity helps point contact between the pressing projection and the dish-shaped metal spring to be change into a state like surface contact. Also, an appropriate flow of the adhesive ensures an increase in a bonding area and an appropriate bonding means provided between the pressing projection and dish-shaped metal spring, to thereby enhance click feeling and bonding durability.

Also, as shown in Table 7, an insufficient viscosity of the elastic adhesive between 5 Pa·s and 10 Pa·s causes the adhesive to flow out, to thereby fail to provide a sufficient bonding strength and migration from point contact to surface contact due to the elasticity of the adhesive. This keeps positional accuracy between the pressing projection and the dish-shaped metal spring from being stabilized, leading to a deterioration in click ratio, as well as a substantial reduction in bonding durability to a level as low as 150,000 times.

Further, as shown in Table 7, an excessive increase in the viscosity of the elastic adhesive to a level as high as 160 Pa·s causes a large amount of the adhesive to remain between the pressing projection and the dome-like dish-shaped metal spring due to an increase in the hardness of the adhesive, leading to a reduction in click ratio from 38% to 27% and an excessive increase in stroke from 0.35 mm to 0.44 mm, resulting in bonding durability being substantially reduced from 1,500,000 times to 500,000 times. Also, an increase in pressure during the bonding causes deformation of the pressing projection, to thereby fail to keep balancing, resulting in inclination of the pressing projection being increased.

Although optimum viscosity of the adhesive is varied depending on pressing load, it is at least 5 Pa·s or more and preferably 10 Pa·s or more in view of construction of the push button switch cover and manufacturing thereof as well as load characteristics and durability. A dish-shaped metal spring commercially available typically has a peak load of at least 140 to 160 gf. In particular, in the present invention, the optimum viscosity is desirably between 20 Pa·s and 150 Pa·s for the purpose of preventing excessive spreading of the adhesive and keeping any gap from being formed between the dish-shaped metal spring and the pressing projection, as well as reducing the amount of application of the adhesive to increase positional accuracy.

Figure 13A:
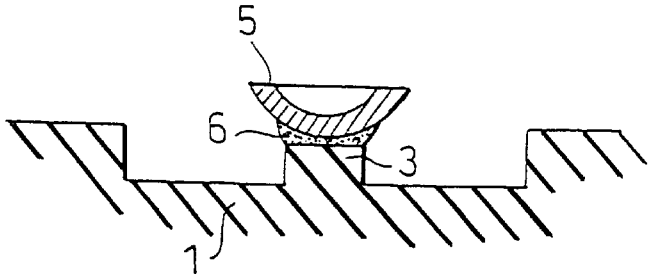
FIGS. 13A to 13C each are a fragmentary vertical sectional view showing bonding of a dish-shaped metal spring to a pressing projection of a cover sheet by means of an adhesive.
Figure 13B:
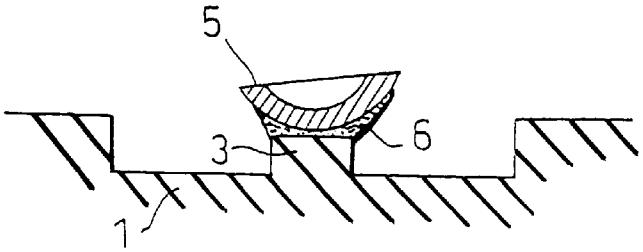

In order to ensure high accuracy during fixing of the dish-shaped metal spring (diameter: 5 mm) having a curved surface to a flat surface of the pressing projection (diameter: 2.0 mm) of the cover sheet, it is essential that the fixing is carried out using the elastic adhesive (such as silyl-group containing polyol-modified adhesive) having an initial viscosity of 20 to 150 Pa·s in an amount of 2 to 7 mg. In this instance, passing and failing judgment on positional accuracy between the dish-shaped metal spring 5 and the pressing projection 3 was carried out on the basis of inclination of the dish-shaped metal spring 5 (a minimum value of the inclination visually confirmed: 2.5 degrees) and positional deviation in both longitudinal and lateral directions (maximum deviation: 0.1 mm). As a result, it was found that the adhesive of 24 Pa·s in viscosity shown in Table 7 ensures satisfactory formation of the elastic adhesive section 6 between the dish-shaped metal spring 5 and the pressing projection 3 as shown in FIG. 13A, whereas the adhesive of 5 Pa·s in viscosity shown in Table 7 excessively spreads as shown in FIG. 13B, to thereby fail to sufficiently hold the dish-shaped metal spring 5 on the pressing projection 3, leading to inclination of the dish-shaped metal spring 5 and an increase in positional deviation between the dish-shaped metal spring 5 and the pressing projection 3 to a level as large as 0.1 mm or more, resulting in the click ratio and bonding durability being deteriorated as shown in Table 7.

Figure 13C:
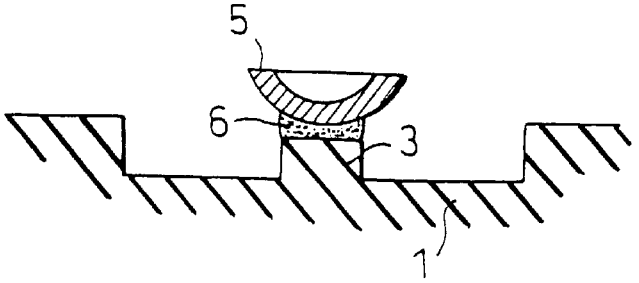
Figure 14:
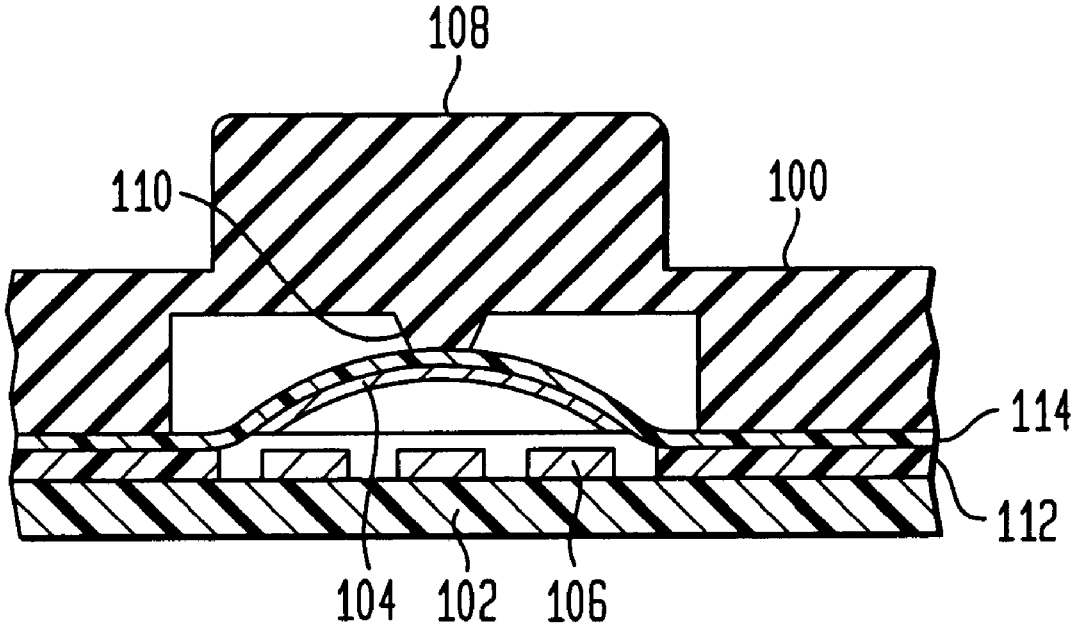
FIG. 14 (PRIOR ART)
FIG. 14 is a fragmentary vertical sectional view showing a switch unit having a conventional push button switch cover incorporated therein.

In addition, application of the adhesive increased in viscosity, i.e, the adhesive of 160 Pa·s in viscosity shown in Table 7 causes a large amount of the adhesive to remain between an apex of the dish-shaped metal spring 5 and the pressing projection 3 as shown in FIG. 13C, so that an increase in pressure during the fixing operation causes deformation of the pressing projection 3, to thereby fail to keep balancing between the pressing projection 3 and the dish-shaped metal spring 5, leading to a deterioration in positional accuracy.

As can be seen from the foregoing, the push button switch cover of each of the second to fourth embodiments is so constructed that the key tops are arranged on the front surface of the cover substrate or sheet and the pressing projections are arranged on the rear surface of the cover substrate or sheet in a manner to correspond to the key tops, wherein the dish-shaped metal springs are each fixed on the pressing projection corresponding thereto by means of the elastic adhesion of 75 to 700% in elongation in an amount of 2 to 7 mg while being abutted at the apex thereof against the central portion of the pressing projection. Such construction substantially increases positioning accuracy between the dish-shaped metal spring and the pressing projection, stabilizes keying load characteristics and eliminates arrangement of the pressure-sensitive adhesive sheet and PET sheet required for fixing the dish-shaped metal springs in the prior art, leading to a reduction in manufacturing cost of the push button switch cover.

Also, the push button switch cover of the second to fourth embodiments ensures satisfactory click feeling and repeat operability over a long period of time.

The invention will be understood more readily with reference to the following examples; however, these examples are intended to illustrate the invention and are not to be construed to limit the scope of the invention.

EXAMPLE 1

In order to provide the dish-shaped metal springs 5, a thin strip of SUS 301 stainless steel (thickness: 0.05 to 0.07 mm) was subjected to punching and drawing using a pressing machine, to thereby obtain a dish-shaped metal spring hoop 20. A material for the dish-shaped metal spring hoop 20 and a thickness thereof may be varied depending on keying characteristics of the dish-shaped metal springs 5 to be obtained such as keying load, pressing feeling and the like. Then, in the dish-shaped metal spring bonding step shown in FIGS. 3 and 4, the dish-shaped metal spring hoop 20 was placed while keeping a concave side of the dish-shaped metal springs 5 facing up and was separated into the dish-shaped metal springs 5 and a hoop section at a dish-shaped metal spring punching position. The dish-shaped metal springs 5 were then carried to the dish-shaped metal spring bonding position 19 while being suckedly held on the lift-equipped suction arms 18 mounted on the table 17 driven by the high-precision index section 16. In the meantime, the cover sheet 1 to which the dish-shaped metal springs were to be bonded was arranged on the cover positioning and carrying jig 21 while keeping the pressing projections 3 facing up and then carried to the adhesive applying section 11 together with the cover positioning and carrying jig 21 while being mounted on the X-Y robot. Then, an adhesive was applied in a predetermined amount to the pressing projections 3 for every key by means of the dispenser of the adhesive applying section 11 and then the cover sheet 1 was positioned with high precision by image processing at the dish-shaped metal spring bonding position 19 so that the pressing projections 3 of the cover sheet 1 may be placed right below the suction arms 18. Thereafter, the suction arms 18 each having the dish-shaped metal spring 5 suckedly held thereon were lowered, resulting in the dish-shaped metal springs 5 being forced against the adhesive-deposited pressing projections 5 of the cover sheet 1 while being aligned with the pressing projections 5 with high accuracy. This permitted the dish-shaped metal springs 5 to be integrated with the cover sheet 1. Subsequently, dish-shaped metal springs 5 were released from suction by the suction arms 18, which were then raised. Then, the cover sheet 1 having the dish-shaped metal springs 5 mounted thereon was left to stand at a normal temperature, leading to fixing between the cover sheet 1 and the dish-shaped metal springs 5, resulting in the push button switch cover 4 being obtained.

At this time, accuracy with which positioning between the pressing projections 3 of the cover sheet 1 and the dish-shaped metal springs 5 (positioning accuracy) is carried out was within a range of ±0.05 mm with respect to a center of the pressing projections 3 and a positioning and carrying speed was 0.3 second for each key.

The thus-manufactured push button switch cover 4 having the dish-shaped metal springs 5 fixedly mounted thereon (positional deviation within ±0.05 mm) and a conventional push button switch cover in combination with the dish-shaped metal springs using a pressure-sensitive adhesive sheet (positional deviation between ±0.2 mm and ±0.5 mm) were subjected to a test for keying load characteristics. The results are shown in Table 8, which indicates that the push button switch cover of the present invention increased in positioning accuracy exhibits stable keying load characteristics as compared with the conventional one.

TABLE 8

| | | Load Characteristic due to Positional Deviation | | | | | |
|---|---|---|---|---|---|---|---|
| | | Push Button Switch Cover of the Present Invention | | Conventional Push Button Switch Cover | | | |
| | | (Positional Deviation of ±0.05 mm) | | (Positional Deviation of ±0.3 mm) | | (Positional Deviation of ±0.5 mm) | |
| Characteristics | Standard Value | Measured Value | Difference between Measured and Standard Values | Measured Value | Difference between Measured and Standard Values | Measured Value | Difference between Measured and Standard Values |
| Peak Load (gf) | 200 ± 20 | 197 | −3 | 205 | 5 | 208 | 8 |
| Click Ratio (%) | 40 or more | 45 | — | 42 | — | 41 | — |
| Make Stroke (mm) | 0.2–0.25 | 0.23 | — | 0.23 | — | 0.25 | — |

EXAMPLE 2

100 parts by weight of silicone rubber commercially available under the tradename KE-961U from Shin-Etsu Chemical Co., Ltd. and 2 parts by weight of crosslinking agent commercially available under the tradename C-8 from Shin-Etsu Chemical Co., Ltd. were kneaded together to prepare a silicone rubber compound, which was charged in a die and heated at 180° C. while being pressurized at 200 kgf/cm$^2$. This resulted in the cover sheet being formed. The pressing projections were formed to have a diameter of 2 mm. The dish-shaped metal springs were formed to have a diameter of 5 mm.

Then, the pressing projections were each bonded to a respective one of the dish-shaped metal springs by means of a silicone adhesive commercially available in the form of a moisture-curing adhesive Super X8008 from Cemedine Co. The adhesive was 40 in Shore A hardness, 100 Pa·s in viscosity and 215% in elongation and was used in an amount of 2 to 7 mg for each pressing projection. The adhesive was left to stand at a room temperature for 24 hours, to thereby be cured. The cover sheet had characteristics shown in Table 4 described above. Repeat durability (keying durability test up to 1,500,000 times) was determined based on whether a residual ratio to an initial value (the ratios of residual values to initial values of peak load and a click ratio) was 80% or more and bonding durability was judged at the time of interface peeling between the pressing projection and the adhesive or dish-shaped metal spring.

In this example, click feeling was evaluated under the conditions that the pressing projection positioned on the rear surface of the push button switch cover (Shore A hardness of 60) corresponding to the key top is 2.0 mm in diameter and the dish-shaped metal spring is 5 mm in diameter. As a result, it was found that a stroke generating peak load F1 (peak stroke S1) and a stroke generating make load F2 (make stroke S2) which are indicated at a solid line A in FIG. 8 are not excessively increased as compared with a broken line C (dish-shaped metal spring per se), resulting in clear operation feeling being exhibited.

EXAMPLE 3

In order to enhance bonding durability and bonding strength even when the elastic adhesive is in an amount below 2 mg in Example 2, a moisture-curing adhesive commercially available in the form of silyl group-containing polyether-modified adhesive Super X8008 from Cemedine Co. and a moisture-curing silicone adhesive commercially available under the tradename KE-4897, KE-1820 from Shin-Etsu Chemical Co., Ltd. or under the tradename Elastozil RT-713 from Wacker Chemical East Asia Ltd. were mixed together to prepare a mixed solution. Alternatively, the adhesives could be individually applied. A content of the silicone adhesive in the mixture was set to be 20 parts by weight in view of polar strength of Super X8008. The remaining procedure was as described in Example 2. The characteristics of this example are shown in Table 9 below.

In this example, 20 parts by weight of moisture-curing silicone adhesive was added in order to enhance bonding strength in view of the fact that the adhesive in an amount of 2 mg in Example 2 caused bonding durability to be reduced to a level as low as 50,000 times. As a result, bonding strength was substantially increased to a level as high as 2,200,000 times.

TABLE 9

| | Characteristics of Push Button Switch | | | | | |
|---|---|---|---|---|---|---|
| Cover Member | Peak Load (gf) | Make Load (gf) | Make Stroke (mm) | Click Ratio (%) | Keying Durability (× 10,000 times) | Bonding Durability (× 10,000 times) |
| Example 2 | 248 | 170 | 0.48 | 32 | 150 | 200 |
| Example 3 | 254 | 167 | 0.38 | 34 | 150 | 220 |

Also, a test was carried out for keying load characteristics of the dish-shaped metal spring-integrated push button switch cover (positional deviation within ±0.05 mm) according to the present invention and those of a conventional push button switch cover in combination with dish-shaped metal springs fixed by a pressure-sensitive adhesive sheet (positional deviation between ±0.3 mm and ±0.5 mm). The results are shown in Table 10. Table 10 indicates that the push button switch cover of the present invention exhibits stabilized keying load characteristics while being increased in positioning accuracy as compared with the prior art.

TABLE 10

| | | Load Characteristic due to Positional Deviation | | | | | |
|---|---|---|---|---|---|---|---|
| | | Push Button Switch Cover of the Present Invention | | Conventional Push Button Switch Cover | | | |
| | | (Positional Deviation of ±0.05 mm) | | (Positional Deviation of ±0.3 mm) | | (Positional Deviation of ±0.5 mm) | |
| Characteristics | Standard Value | Measured Value | Difference between Measured and Standard Values | Measured Value | Difference between Measured and Standard Values | Measured Value | Difference between Measured and Standard Values |
| Peak Load (gf) | 200 ± 20 | 197 | −3 | 205 | 5 | 280 | 80 |
| Click Ratio (%) | 40 or more | 45 | — | 42 | — | 32 | — |
| Make Stroke (mm) | 0.2–0.25 | 0.23 | — | 0.23 | — | 0.17 | — |

Diameter of Dish-shaped Metal Spring: 5.0 mm
Diameter of Pressing Projection: 2.5 mm While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A push button switch cover comprising:

a cover substrate provided on a front surface thereof with at least one key top and on a rear surface thereof with at least one pressing projection in a manner to correspond to said key top; and at least one dish-shaped metal spring arranged on said pressing projection corresponding thereto;

said dish-shaped metal spring being fixed on said pressing projection corresponding thereto through an adhesive section in a manner to be abutted at an apex thereof against a central portion of said pressing projection.

2. A push button switch cover as defined in claim 1, wherein said adhesive section comprises an elastic adhesive having an elongation of 75 to 700% in an amount of 2 to 7 mg.

3. A push button switch cover as defined in claim 2, wherein said elastic adhesive has an elongation of 75 to 250%.

4. A push button switch cover as defined in claim 2, wherein said elastic adhesive has an initial viscosity of 20 to 150 Pa·s.

5. A push button switch cover as defined in claim 4, wherein said elastic adhesive has an initial viscosity of 30 to 100 Pa·s.

6. A push button switch cover as defined in claim 2, wherein said elastic adhesive is constituted of 100 parts by weight of a main adhesive ingredient and 5 to 50 parts by weight of a silicone adhesive ingredient.

7. A push button switch cover as defined in claim 2, wherein said cover substrate is made of silicone rubber having a Shore A hardness of 40 to 70;

said pressing projection is integrally formed on said cover substrate; and said elastic adhesive section has a Shore A hardness of 20 to 90.

8. A push button switch cover as defined in claim 1, wherein said pressing projection is integrally formed on said rear surface of said cover substrate; and said key top is integrally formed on said front surface of said cover substrate.

9. A push button switch cover as defined in claim 1, wherein said pressing projection is integrally formed on said rear surface of said cover substrate; and said key top is made of a resin material and bonded to said front surface of said cover substrate.

10. A push button switch cover comprising:

at least one key top;

at least one pressing projection arranged on a rear side of said key top; and at least one dish-shaped metal spring having a dome-shaped top and arranged on said pressing projection corresponding thereto;

said dish-shaped metal spring being bonded at said dome-shaped top thereof to a central portion of said pressing projection by means of an elastic adhesive section.

11. A push button switch cover as defined in claim 10, wherein said elastic adhesive section comprises an elastic adhesive having an elongation of 75 to 700% in an amount of 2 to 7 mg.

12. A push button switch cover as defined in claim 11, wherein said elastic adhesive has an elongation of 75 to 250%.

13. A push button switch cover as defined in claim 11, wherein said elastic adhesive section comprises an elastic adhesive having an initial viscosity of 20 to 150 Pa·s.

14. A push button switch cover as defined in claim 13, wherein said elastic adhesive has an initial viscosity of 30 to 100 Pa·s.

15. A push button switch cover as defined in claim 11, wherein said elastic adhesive is constituted of 100 parts by weight of a main adhesive ingredient and 5 to 50 parts by weight of a silicone adhesive ingredient.

16. A push button switch cover as defined in claim 11, wherein a cover substrate made of silicone rubber having a Shore A hardness of 40 to 70 is arranged;

said pressing projection is integrally formed on said cover substrate; and said elastic adhesive has a Shore A hardness of 20 to 90.

17. A push button switch cover as defined in claim 16, wherein said pressing projection is arranged on a rear surface of said cover substrate; and said key top is arranged on a front surface of said cover substrate.

18. A push button switch cover as defined in claim 16, wherein said pressing projection is integrally formed on said rear surface of said cover substrate; and said key top is made of a resin material and bonded to said front surface of said cover substrate.

* * * * *